US012151843B2

(12) United States Patent
Giuliani et al.

(10) Patent No.: US 12,151,843 B2
(45) Date of Patent: Nov. 26, 2024

(54) FUNCTIONAL MODULE FOR MOVING TO A DOSING STATION POSITIONED IN A PROCESS CHAMBER OF A CONTAINMENT SYSTEM AND CORRESPONDING METHOD

(71) Applicant: PHARMA INTEGRATION S.R.L., Siena (IT)

(72) Inventors: Matteo Giuliani, Siena (IT); Andrea Roncara, Casciano di Murlo (IT)

(73) Assignee: Pharma Integration S.R.L. (IT)

( * ) Notice: Subject to any disclaimer, the term of this patent is extended or adjusted under 35 U.S.C. 154(b) by 52 days.

(21) Appl. No.: 18/014,460

(22) PCT Filed: Jul. 16, 2021

(86) PCT No.: PCT/IB2021/056440
§ 371 (c)(1),
(2) Date: Jan. 4, 2023

(87) PCT Pub. No.: WO2022/013830
PCT Pub. Date: Jan. 20, 2022

(65) Prior Publication Data

US 2023/0257148 A1 Aug. 17, 2023

(30) Foreign Application Priority Data

Jul. 17, 2020 (EP) ..... 20405021

(51) Int. Cl.
*B65B 3/00* (2006.01)
*B65B 55/02* (2006.01)

(52) U.S. Cl.
CPC ..... *B65B 55/027* (2013.01); *B65B 3/003* (2013.01)

(58) Field of Classification Search
USPC ..... 53/425
See application file for complete search history.

(56) References Cited

U.S. PATENT DOCUMENTS

2015/0034207 A1* 2/2015 Boira Bonhora ..... A61J 1/05 141/83
2016/0200462 A1* 7/2016 Kriheli ..... G06Q 10/06316 700/214
2016/0326573 A1* 11/2016 Spence ..... G01L 1/00

FOREIGN PATENT DOCUMENTS

EP 2635335 A1 9/2013
EP 2976117 A1 1/2016
EP 3028946 A1 6/2016
EP 3335844 A1 * 6/2018 ..... B08B 15/023
EP 3356238 A1 8/2018

* cited by examiner

*Primary Examiner* — Chinyere J Rushing-Tucker
(74) *Attorney, Agent, or Firm* — Endurance Law Group PLC

(57) ABSTRACT

A containment system for placement in an installation space includes a housing which encloses a process chamber, a dosing station for the aseptic filling of vessels with a liquid, positioned in the process chamber, a transfer port leading into the process chamber, and a functional module which can be moved up to the dosing station, The module includes an element carrier, functional elements installed on the element carrier, and media feed lines connected to the functional elements. The functional module with the element carrier, the functional elements, and the media feed lines is movable from an initial position, through a transfer port leading into the process chamber, to an operating position at the dosing station.

18 Claims, 13 Drawing Sheets

Figure 1A:
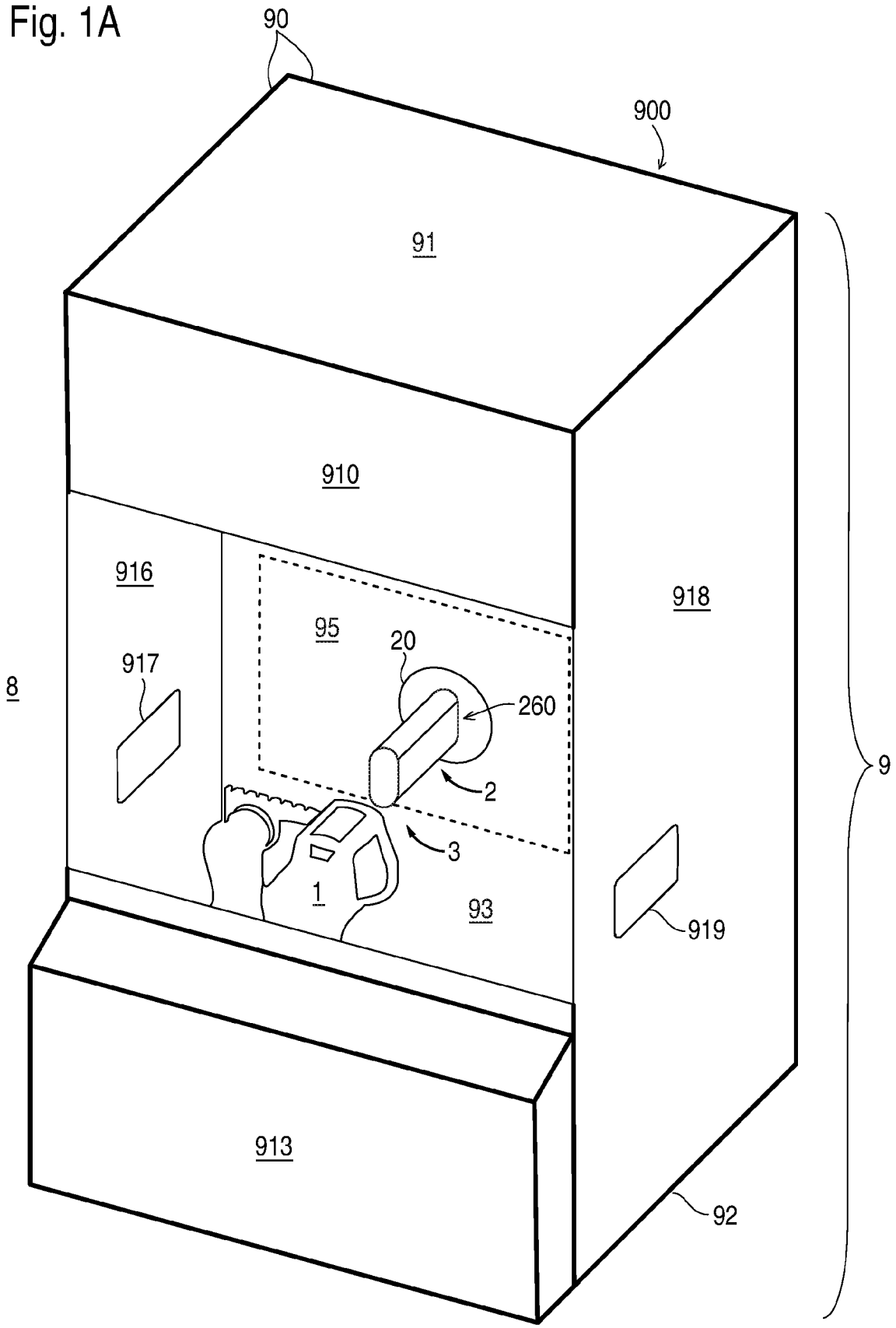

Fig. 3A
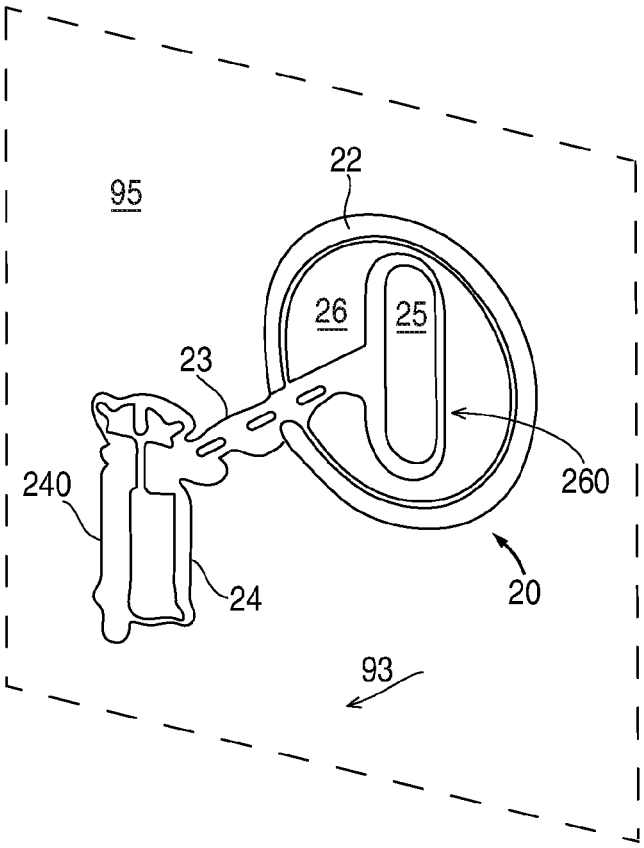
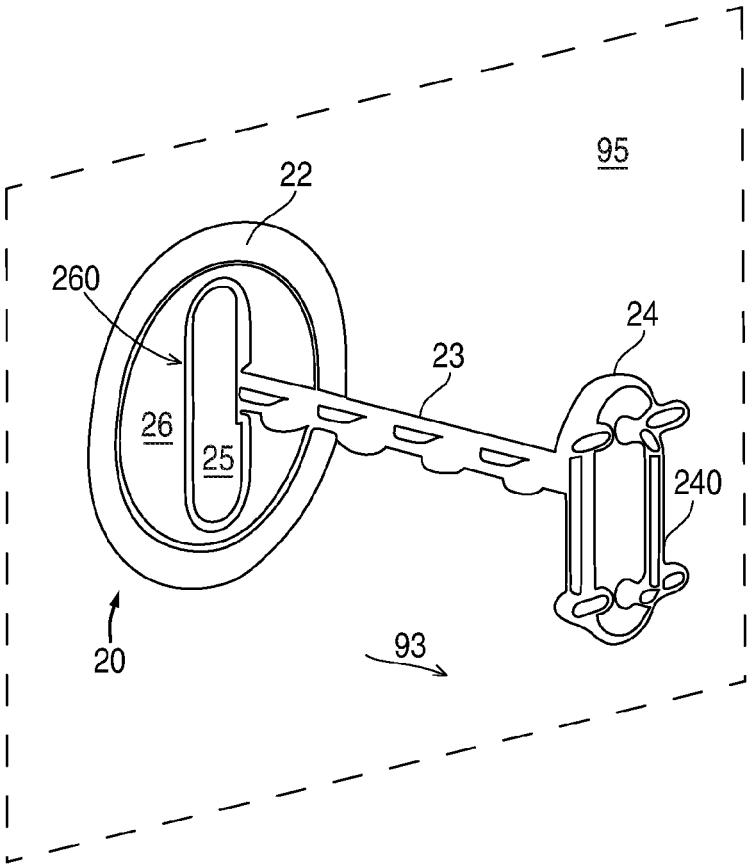
Fig. 3B

Fig. 7A
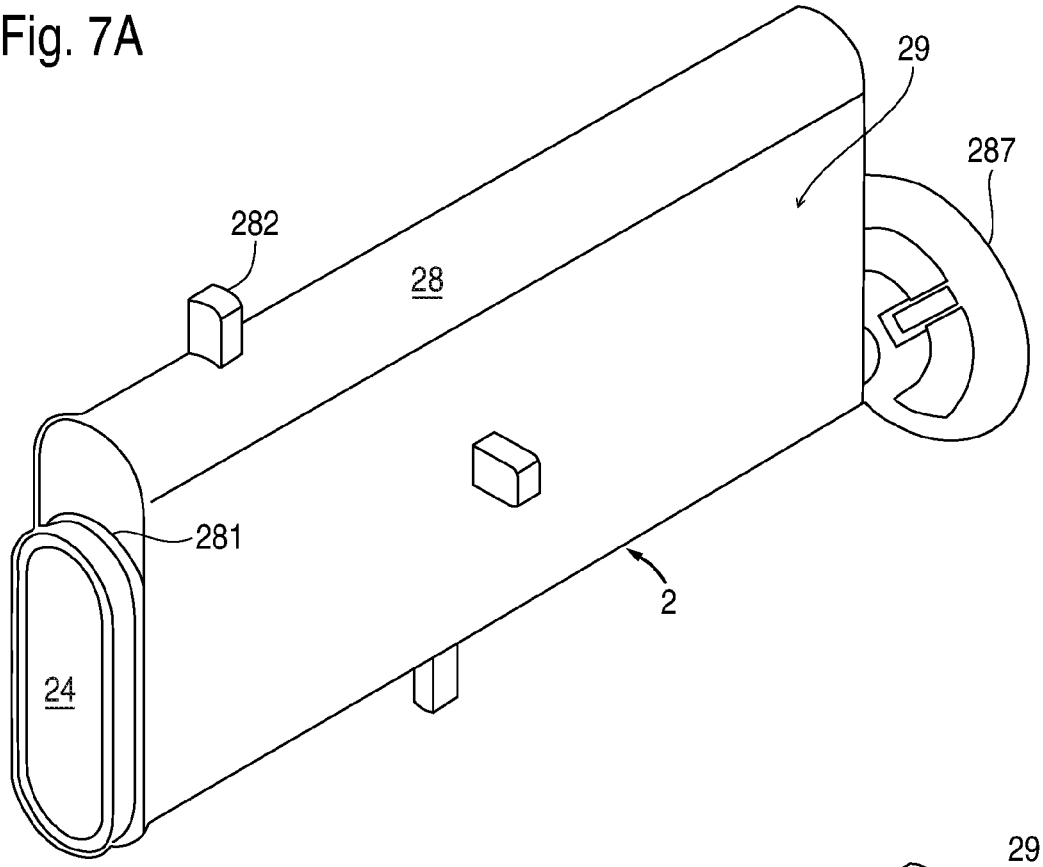
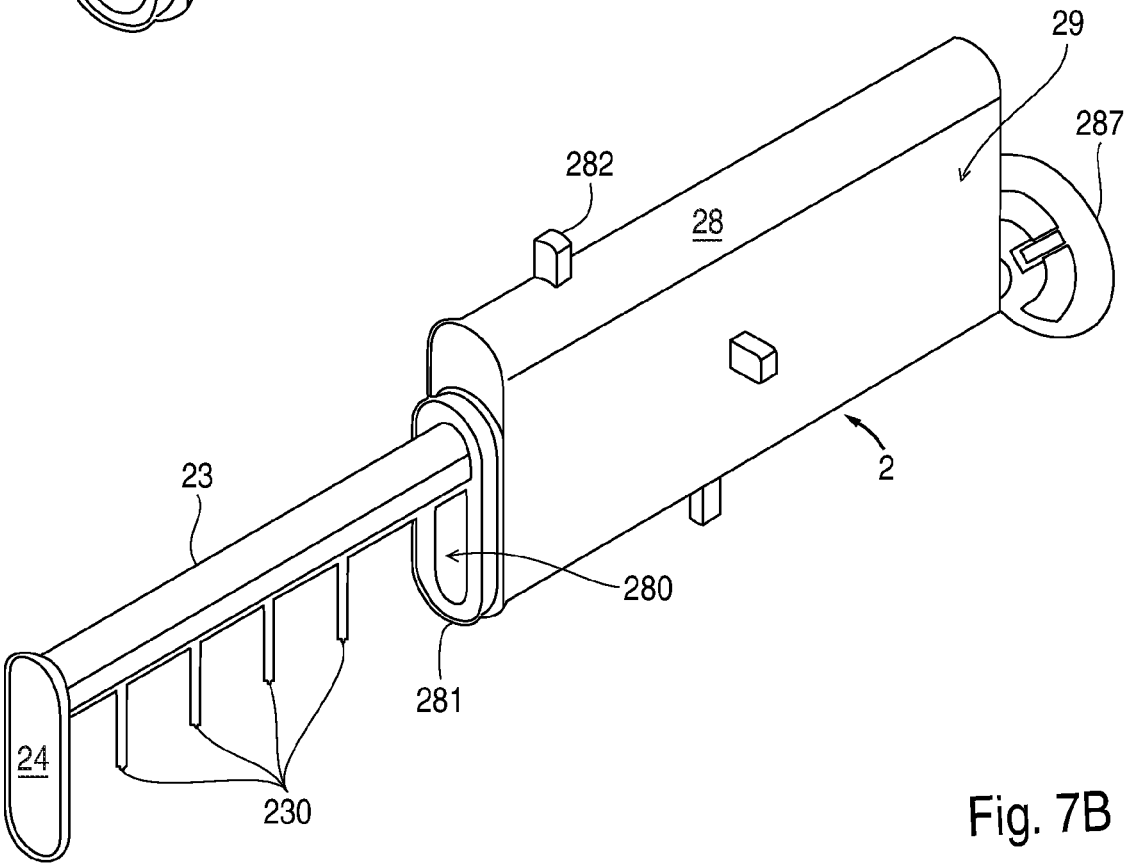
Fig. 7B

FUNCTIONAL MODULE FOR MOVING TO A DOSING STATION POSITIONED IN A PROCESS CHAMBER OF A CONTAINMENT SYSTEM AND CORRESPONDING METHOD

FIELD OF INVENTION

The invention relates to a functional module for moving to a dosing station positioned in a process chamber of a containment system, where it is intended for the aseptic filling of vessels with a liquid. The containment system is designed to be placed in an installation space, the containment system and the process chamber being enclosed by a housing. The functional module comprises an element carrier, functional elements intended for installation on the element carrier and media feed lines designed to be connected to the functional elements. Furthermore, the invention relates to a method for moving the conceived functional module to the dosing station.

PRIOR ART

The components of functional modules for dosing stations on filling machines for the aseptic filling of liquids into vessels, in particular vials for pharmaceuticals, have until now first had to be introduced into the process chamber of containment systems by means of rapid transfer ports (RTPs). The components are then assembled in the process chamber, thus requiring a manual intervention in the process chamber. This workflow is time-consuming, incurs risks involving incorrect manipulation and contamination, and is costly in terms of plant engineering.

PURPOSE OF INVENTION

In view of the hitherto imperfect solution in the field outlined according to the above prior art, the problem addressed by the invention is that of at least reducing manual activities in the process chamber, and thereby making the workflow more efficient in terms of time, less prone to errors, of higher quality and incurring lower expenditure on equipment. In particular, the risk of contamination due to manual activities in the process chamber needs to be excluded. To this end, a special device needs to be developed along with a proposed method of application for the device.

OVERVIEW OF INVENTION

The conceived functional module is intended to be moved to a dosing station positioned in a process chamber of a containment system for the aseptic filling of vessels with a liquid. The containment system is intended to be placed in an installation space, the containment system and process chamber being enclosed by a housing. The functional module comprises an element carrier, functional elements intended to be installed on the element carrier, and media feed lines which are connected to the functional elements. The assemblage as an assembly, consisting of the element carrier, functional elements mounted thereon and media feed lines connected to the functional elements, can be moved from a retracted initial position through a transfer port leading into the process chamber to an extended operating position at the dosing station.

Particularly advantageous details of the functional module are indicated below: The functional module is used for the aseptic filling of a plurality of vessels, combined to form a bundle, with a pharmacological or toxic liquid. Oxygen-sensitive liquids are handled by overlaying them with a protective gas, e.g. nitrogen. The housing of the containment system has as a component a rear wall delimiting the process chamber. The transfer port is formed by an opening provided in a moulded section of a flanged connection installed in the rear wall.

Especially in the case of the first version of the functional module, the element carrier has a front piece fastened to the front and an end piece fastened to the rear. In the retracted initial position, the front piece comes to rest in the transfer port. The end piece, on the other hand, is intended to abut against the transfer port in the extended operating position and to provide a throughway for the media feed lines leading to the functional module. In the retracted initial position, the functional module installed at the transfer port projects into a transfer cell adjacent to the process chamber. The transfer port forms an interface between the process chamber and the transfer cell. In an outer wall belonging to the housing of the containment system, which outer wall delimits the transfer cell from the installation space, there are provided:

a) a transfer fitting, preferably designed as a rapid transfer port (RTP), intended for the protected introduction of the pre-sterilised functional elements and media feed lines into the transfer cell; and b) glove ports, usually in pairs, in order to carry out activities, in particular assembly work, while maintaining the sterile atmosphere in the transfer cell, specifically the loading of the element carrier with functional elements and media feed lines to be connected thereto.

Especially in the case of the second version of the functional module, it comprises:

a) a gas-tight container with a sterilised interior; and b) a sterilised assembly mounted in the container and consisting of the element carrier, functional elements mounted thereon and media feed lines connected to the functional elements and leading to an external connection or external connections, as well as the front piece fastened to the front of the element carrier.

In the retracted initial position, the assembly is positioned inside the container and the front piece closes off a passage on the container in a gas-tight manner. To reach the operating position, the assembly, with the front piece leading, can be moved out of the container through the transfer port leading into the process chamber to the dosing station.

On the functional module there are provided:

a) one or more connections on the outside of the container to which the media feed lines from inside the container are connected, the connection or connections being intended for connection to at least one supply line; and b) an actuator on the outside of the container for moving the assembly, consisting of an element carrier with front piece, functional elements mounted on the element carrier and media feed lines connected to the functional elements.

The functional module is installed at the transfer port in such a way that it projects into a transfer cell adjacent to the process chamber and can extend into the installation space or the entire functional module extends freely into the installation space. The external connection or external connections and an actuator for moving the assembly, consisting of an element carrier with front piece, functional elements mounted on the element carrier and media feed lines connected to the functional elements, are accessible from the installation space. The transfer cell can be open to the installation space, e.g. through a wall opening in the outer wall.

The following essential method steps are carried out, especially when using the first version of the functional module:

a) preparing, outside the process chamber, the element carrier loaded with functional elements and the media feed lines connected thereto; and b) moving the mounted assembly, consisting of the element carrier, functional elements mounted thereon and media feed lines connected to the functional elements, in a decontaminated or sterilised state from the retracted initial position through the sealed transfer port provided in the housing wall delimiting the process chamber into the extended operating position at the dosing station.

Particularly advantageous details of the method when using the first version of the functional module are indicated below: Preparation and assembly of the element carrier with functional elements and media feed lines takes place under aseptic conditions in a transfer cell which adjoins the process chamber and can be hermetically sealed off from the installation space. Partially extending the element carrier into the process chamber causes the front piece, which is fixed to the front of the carrier, to open the transfer port between the process chamber and the transfer cell. In this position, decontamination of the process chamber, transfer cell and element carrier takes place by injecting a decontamination agent, preferably simultaneously from the process-chamber side and the transfer-cell side. The pre-sterilised functional elements and media feed lines are subsequently introduced into the transfer cell by means of the transfer fitting, while maintaining aseptic conditions. Finally, using the glove ports and maintaining the sterile atmosphere in the transfer cell, the element carrier is loaded with functional elements and the media feed lines are connected thereto.

In the initial position, the mounted assembly, comprising the element carrier, functional elements mounted thereon and media feed lines connected to the functional elements, is located in the transfer cell, and a front piece located at the front of the element carrier is positioned in the transfer port. To reach the operating position, this mounted assembly is moved out of the transfer cell, guided or supported in a slide-like manner, to the dosing station until the end piece at the back of the element carrier comes into contact with the transfer port. The assembly is moved into the operating position by pushing it from the transfer cell side or by pulling it from the process chamber side, e.g. by means of a robot installed in the process chamber.

The following essential steps are carried out, especially when using the second version of the functional module:

a) preparing the functional module, comprising:

aa) a gas-tight container with a sterilised interior; and ab) the sterilised assembly mounted in the container and consisting of an element carrier with front piece, functional elements mounted on the element carrier and media feed lines connected to the functional elements and leading to a common external connection or individual connections, the assembly being retracted in its initial position inside the container, the front piece sealing a passage on the container in a gas-tight manner, and the assembly, with the front piece leading, being moved, guided in a slide-like manner, out of the container to the dosing station in order to reach the operating position;

b) installing the functional module in the initial position, sealed against the transfer port, so that the outer surface of the front piece faces into the process chamber;

c) decontaminating the process chamber concurrently with the outer surface of the front piece;

d) advancing the assembly to the dosing station in order to reach the operating position; and finally e) connecting supply lines to the external connection or external connections, wherein f) method step e) can alternatively take place between method steps c) and d) or between method steps b) and c).

Particularly advantageous details of the method using the second version of the functional module are indicated below: The functional module is installed at the transfer port such that:

a) the functional module projects into a transfer cell adjacent to the process chamber and can extend into the installation space or the entire functional module extends freely into the installation space; and b) the external connection or the external connections and an actuator for moving the assembly, consisting of an element carrier with front piece, functional elements mounted on the element carrier and media feed lines connected to the functional elements, are accessible from the installation space and/or from the transfer cell.

BRIEF DESCRIPTION OF APPENDED DRAWINGS

Figure 1B:
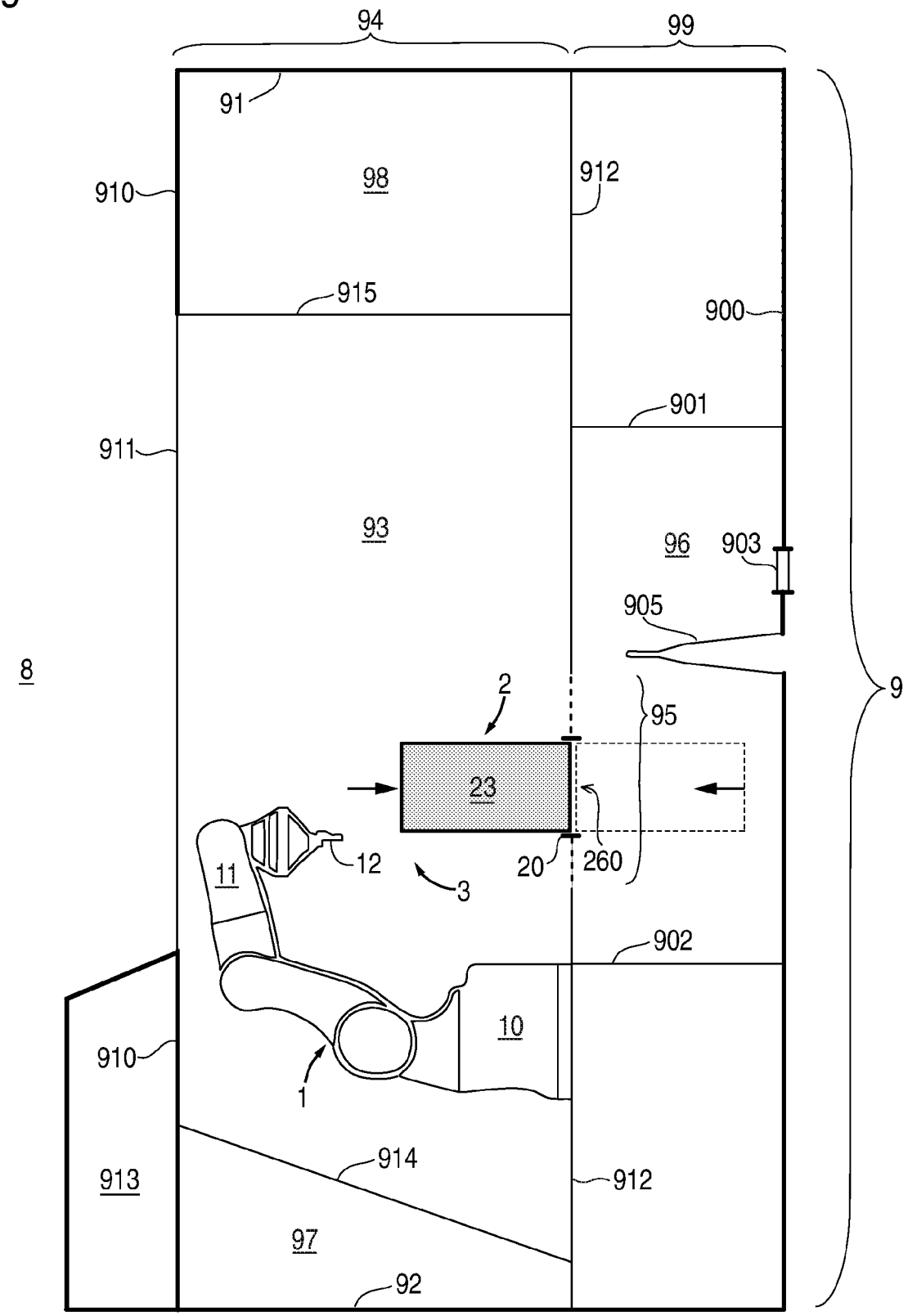
Figure 2A:
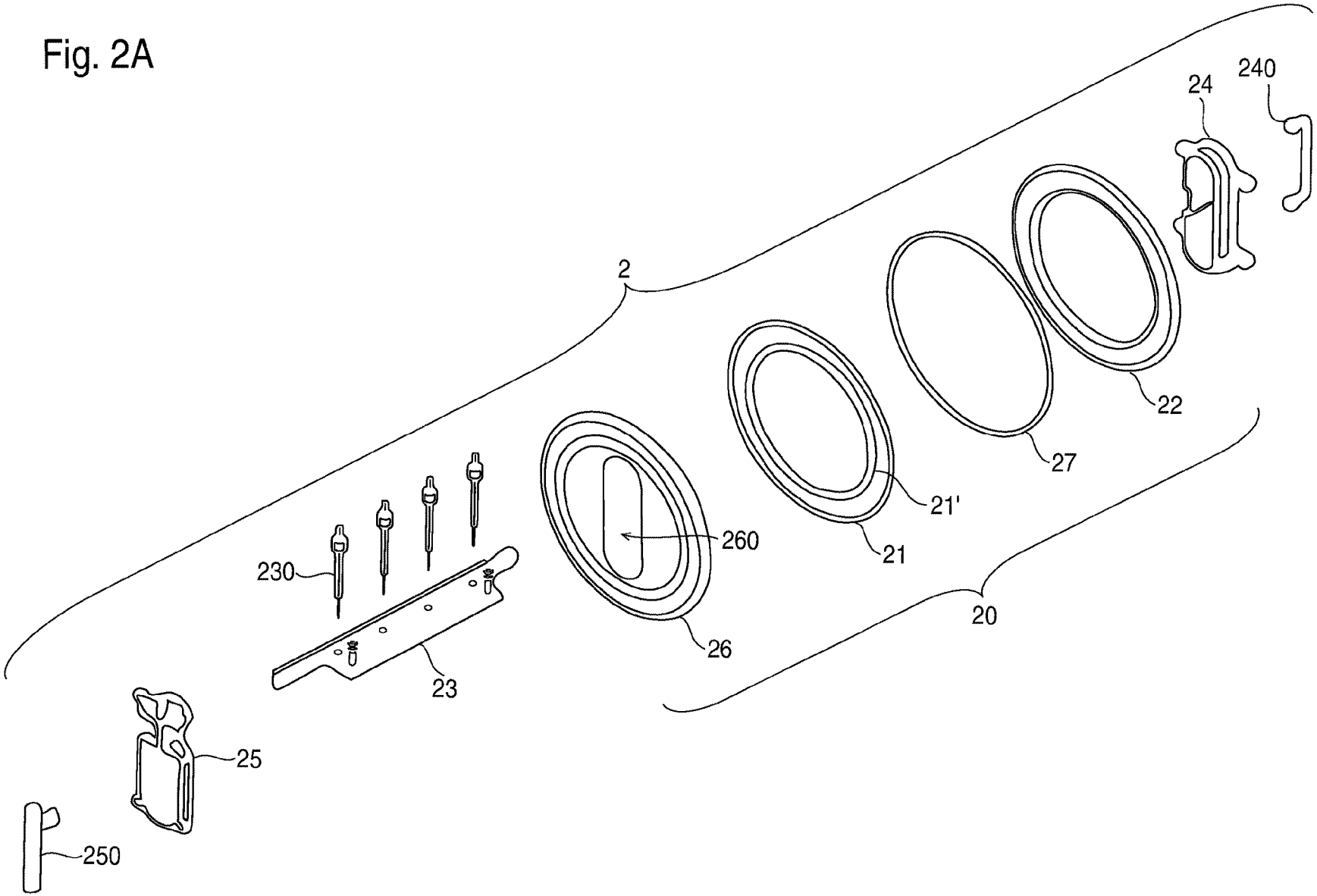
Figure 2B:
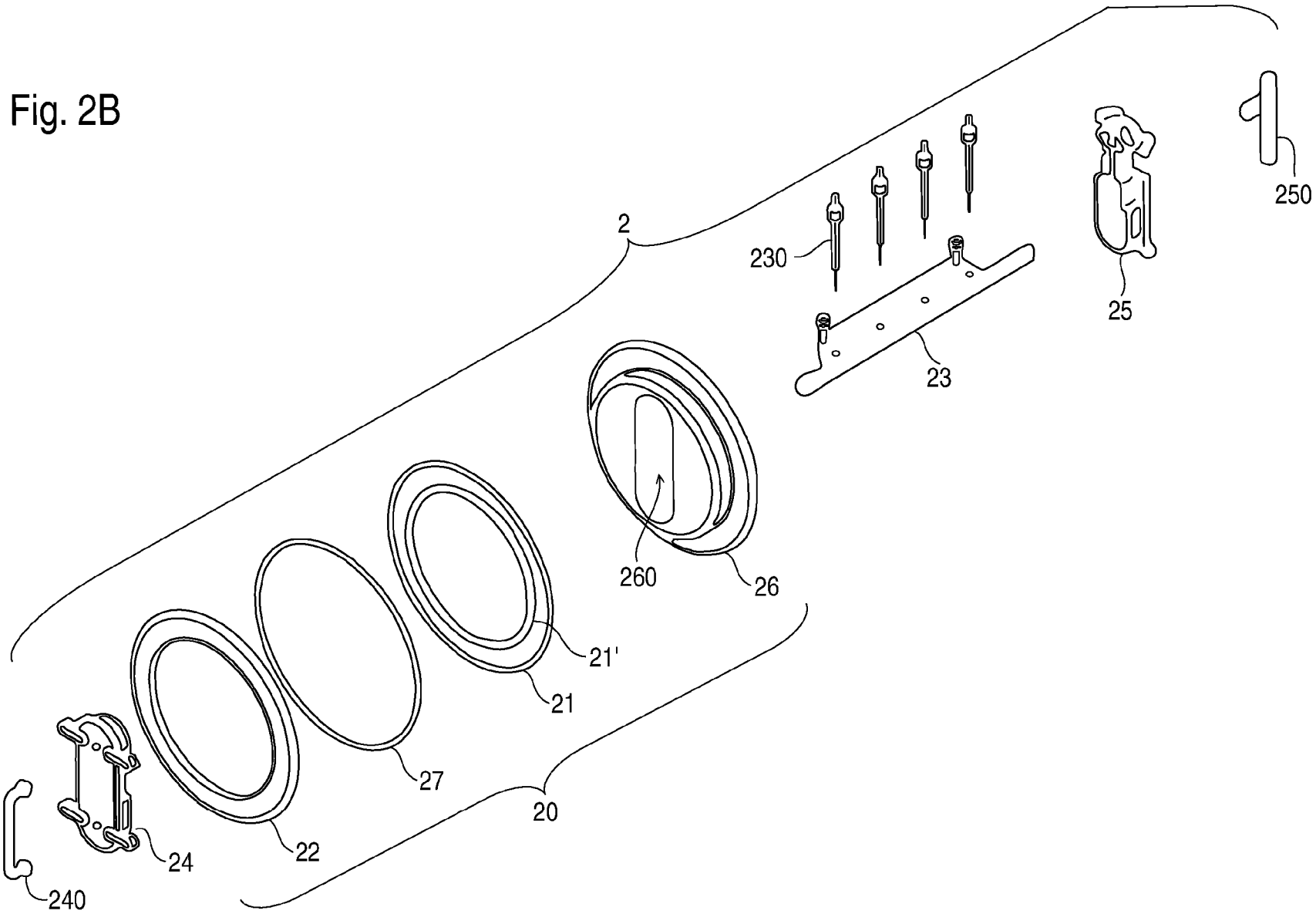
Figure 4A:
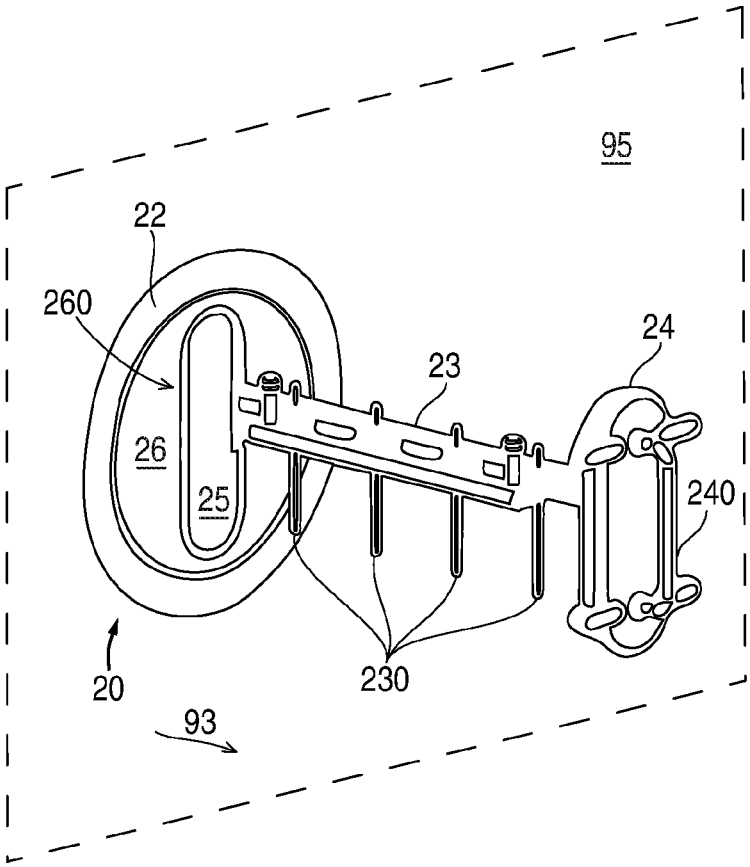
Figure 4B:
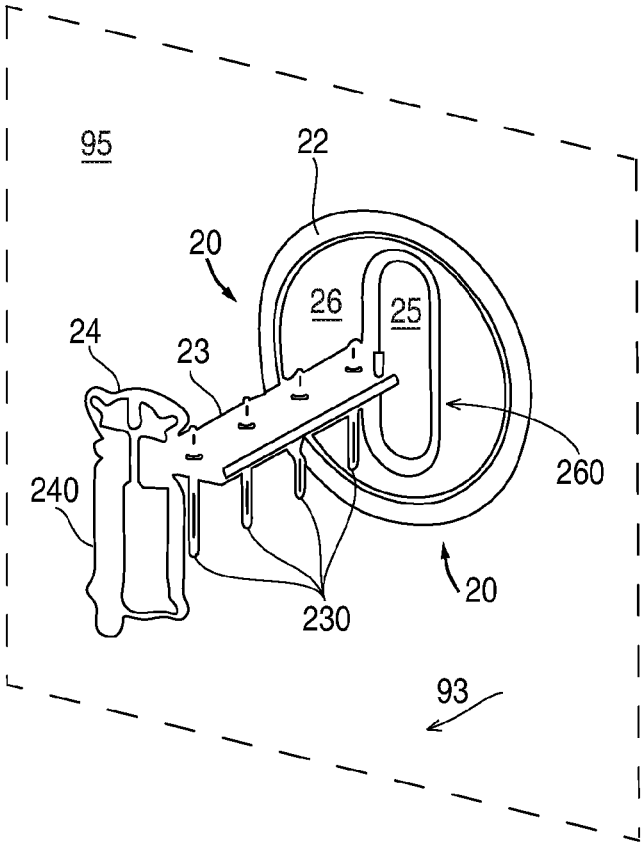
Figure 5:
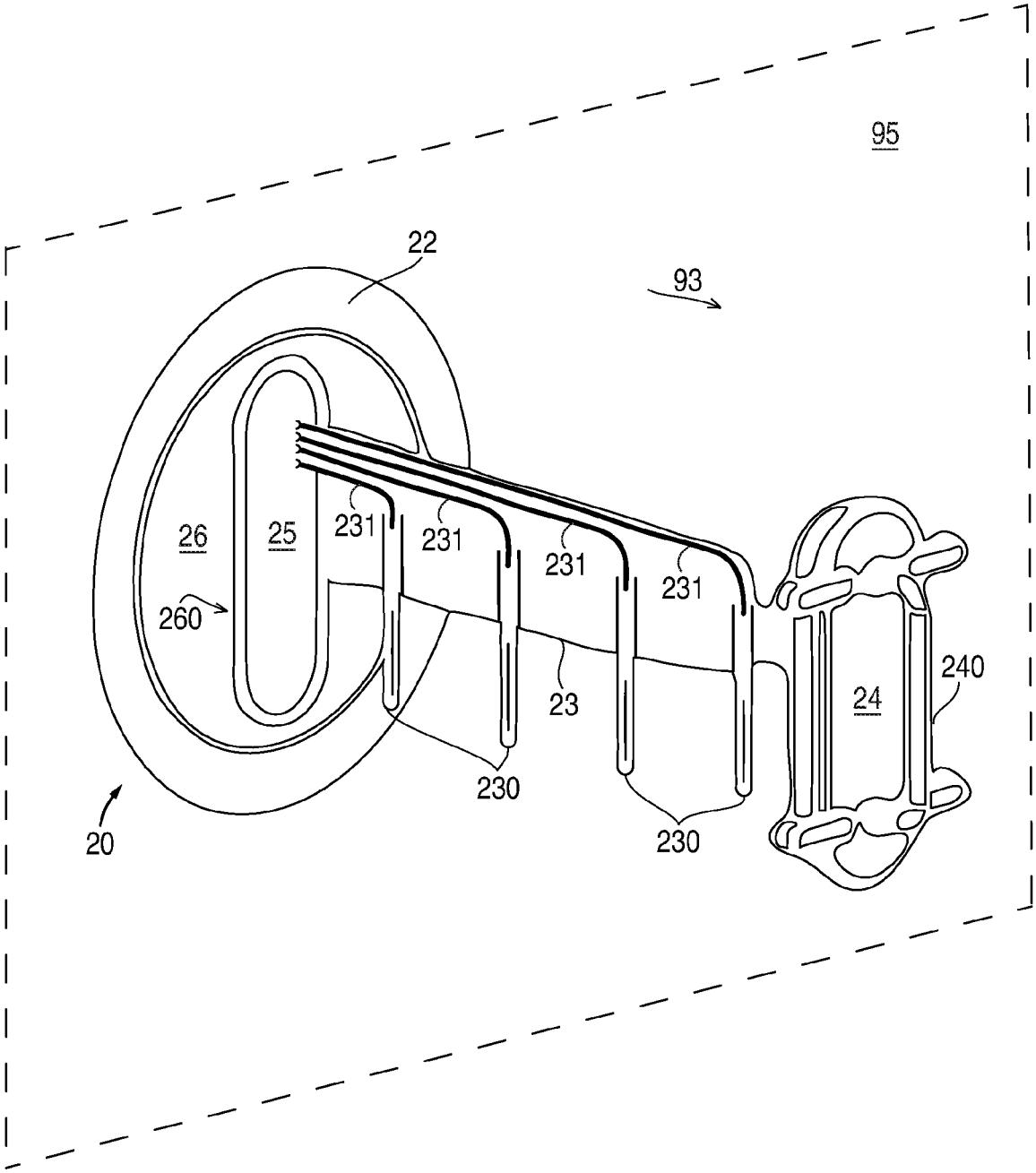
Figure 6:
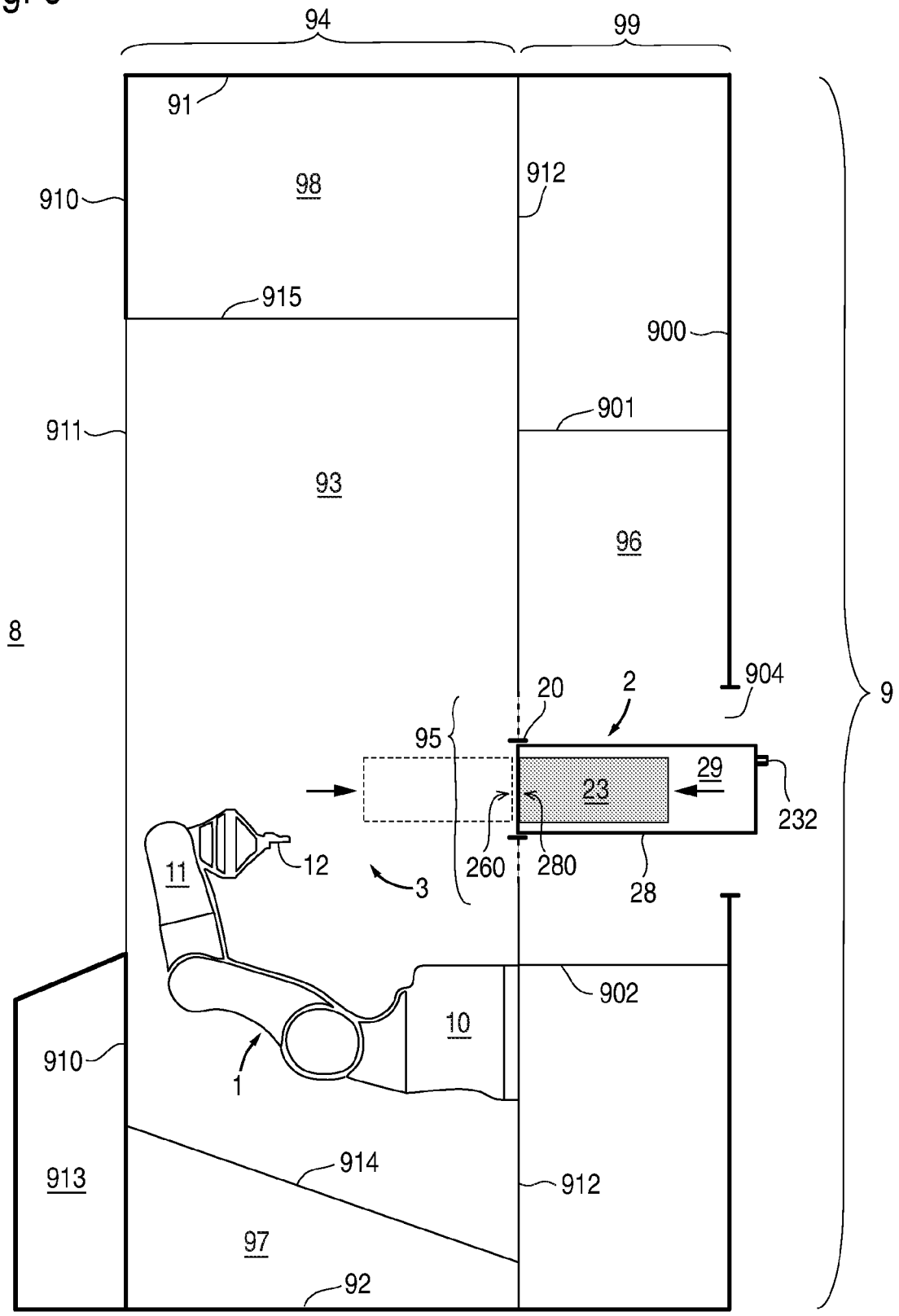
Figure 7C:
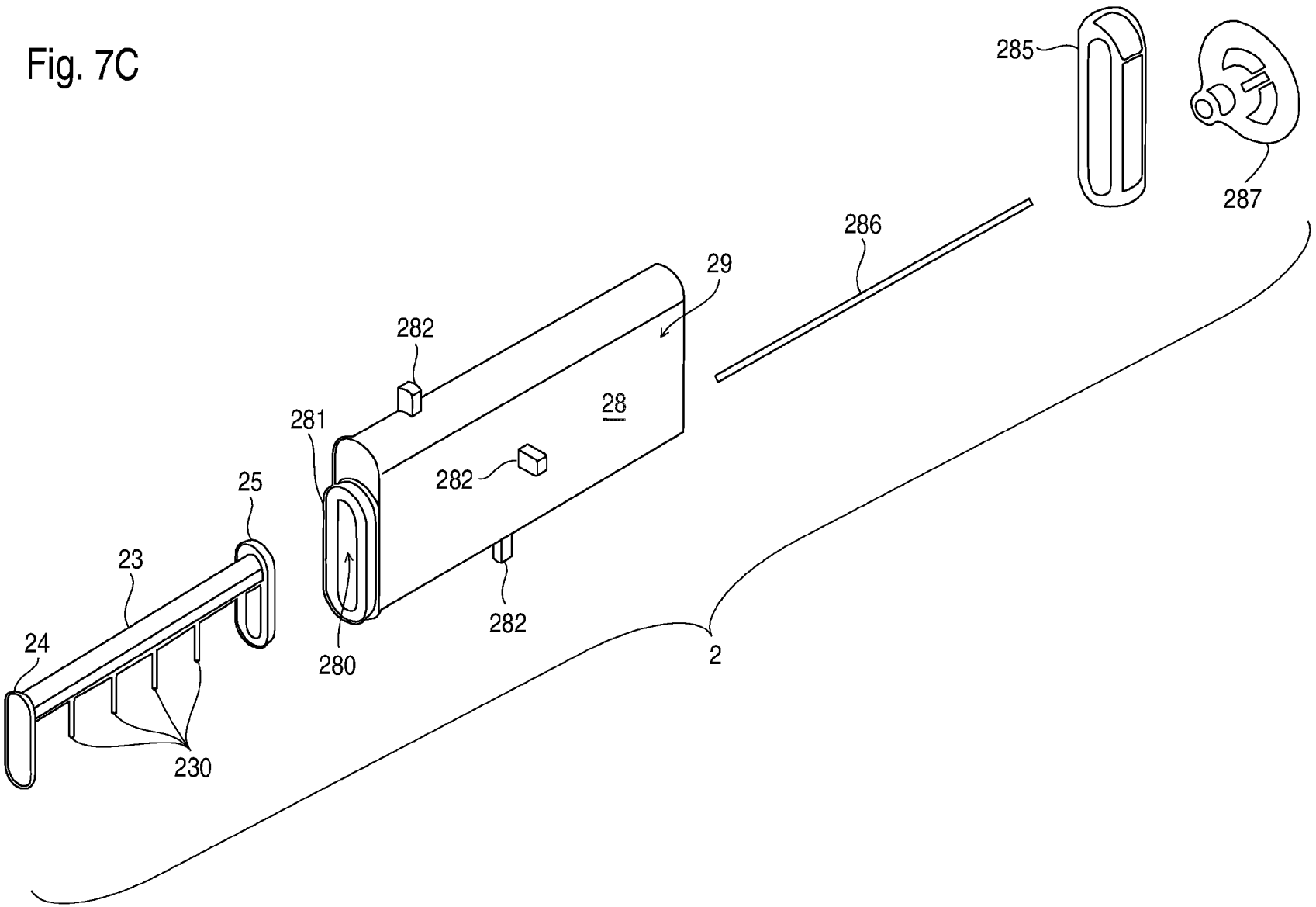
Figure 8A:
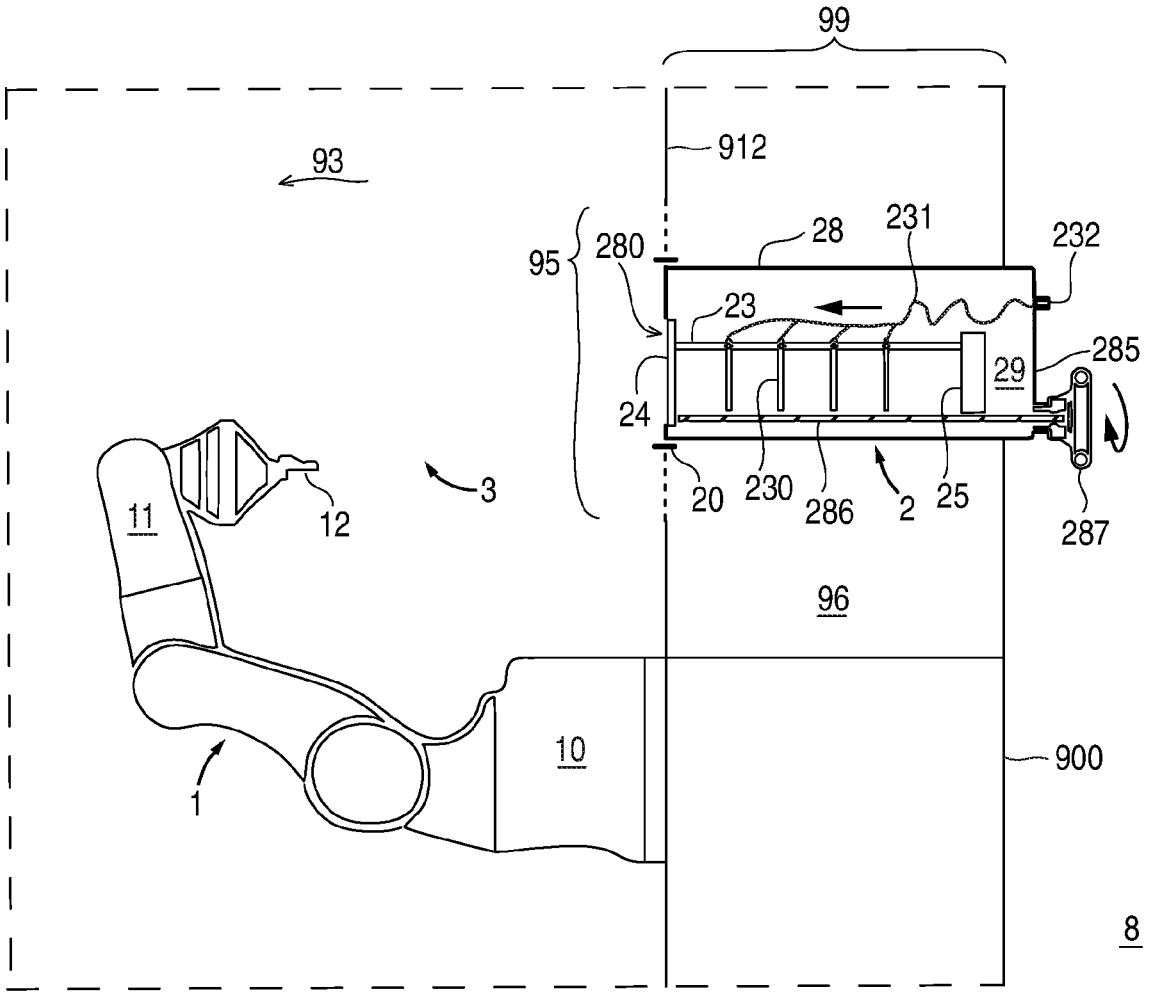
Figure 8B:
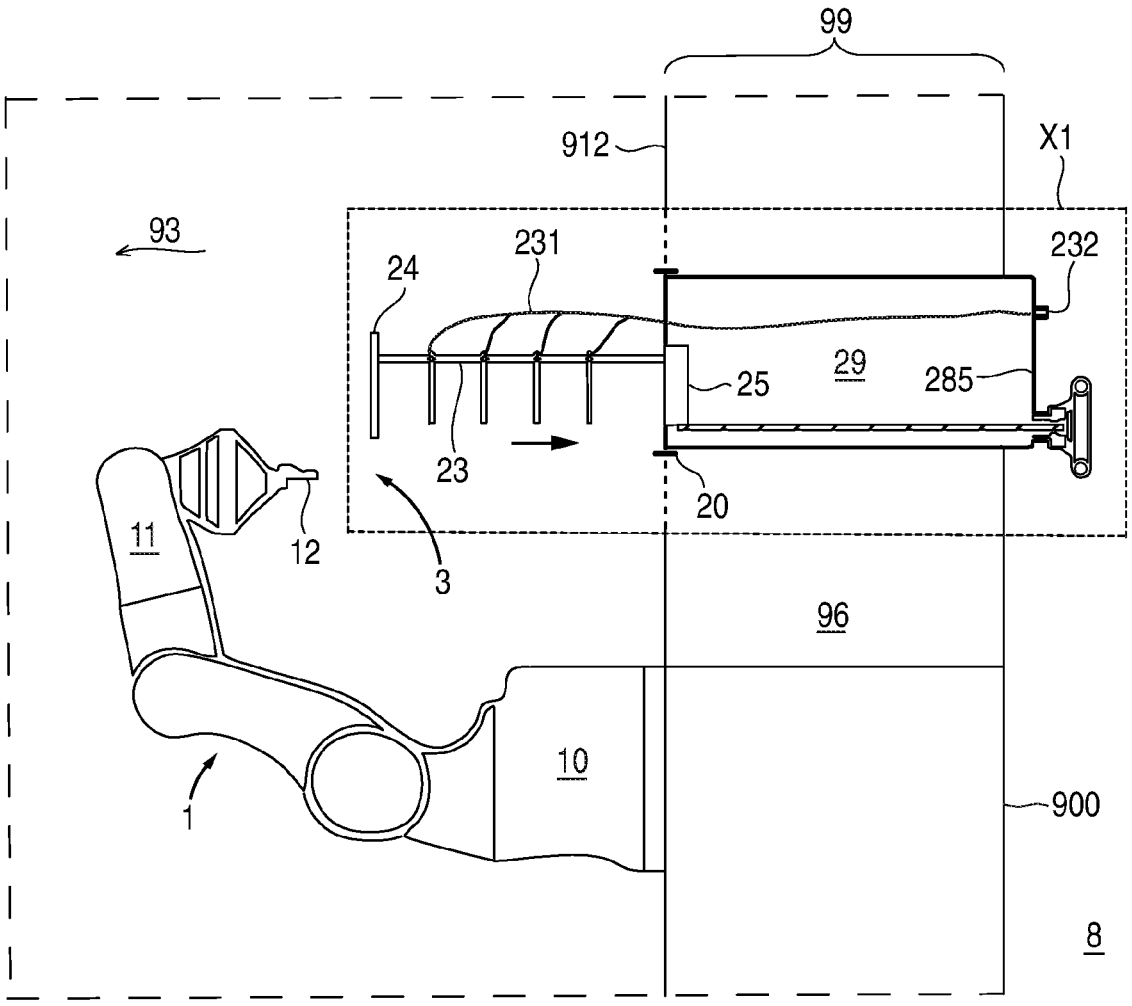
Figure 8C:
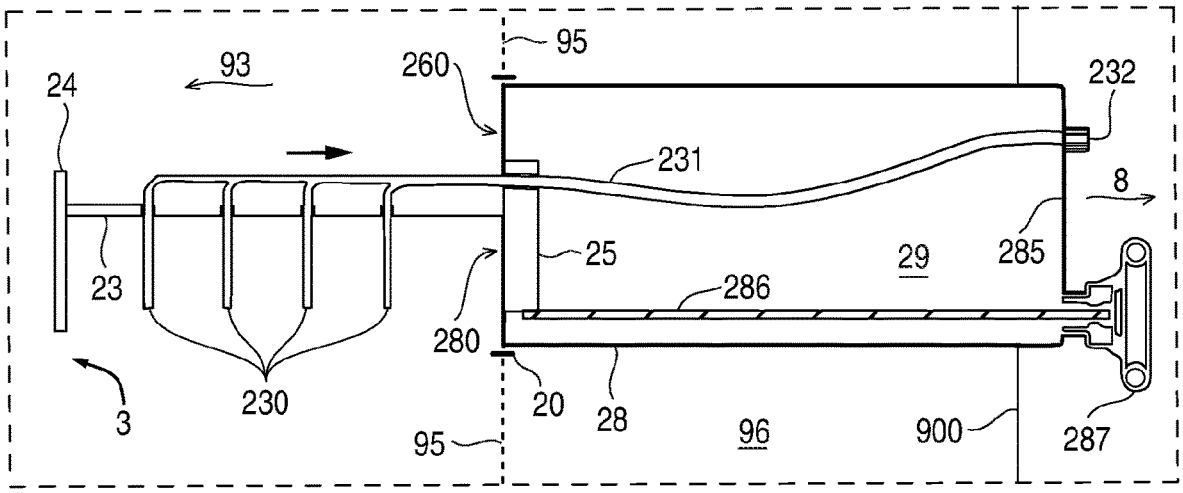

The following figures illustrate the indicated content:

FIG. 1A—Perspective view of a containment system with a view into the process chamber in which the first version of the functional module has been extended into the operating position;

FIG. 1B—Transparent side view of the structure shown in FIG. 1A;

FIG. 2A—Exploded perspective view of the functional module from FIG. 1A;

FIG. 2B—Alternate exploded perspective view of the representation according to FIG. 2A;

FIG. 3A—Perspective view of the unloaded functional module from FIG. 1A extended into the process chamber in the operating position;

FIG. 3B—Alternate perspective view of the representation according to FIG. 3A;

FIG. 4A—Perspective view of the representation according to FIG. 3B, with functional elements inserted in the functional module;

FIG. 4B—Alternate perspective view of the representation according to FIG. 4A;

FIG. 5—Perspective view of the representation according to FIG. 4A with functional elements inserted in the functional module and connected media feed lines;

FIG. 6—Transparent side view of the containment system shown in FIG. 1A with the second version of the functional module integrated into the transfer cell at rest in the retracted initial position in the container, assembly consisting of element carrier, functional elements and media feed lines;

FIG. 7A—Perspective view of the functional module from FIG. 6 in the retracted initial position;

FIG. 7B—Perspective view of the representation according to FIG. 7A in the extended operating position;

FIG. 7C—Perspective exploded view of the functional module from FIG. 6;

FIG. 8A—Enlarged detail from FIG. 6, with transparent view of the functional module;

FIG. 8B—Representation according to FIG. 8A, with the functional module in the extended operating position; and FIG. 8C—Enlarged detail X1 from FIG. 8B.

EMBODIMENT EXAMPLES

The following is a detailed description of the functional module according to the invention in two different versions with reference to the appended drawings and in addition, in the form of a method, the assembly procedure, the establishment of operational readiness and the application of the functional module.

The following stipulation applies to the whole of the remainder of the description: if reference numbers are included in a figure for the purpose of clarifying the drawing but are not explained in the directly associated descriptive text, reference is made to their mention in the description of preceding or subsequent figures.

FIGS. 1A and 1B

The containment system 9, enclosed by a housing 90, here in the form of an isolator positioned in the installation space 8, is shown in the basic structure for the purpose of clarifying the internal division of the space, the existing walls and the equipment. In the front wall 910 there is usually a transparent pane 911, while an exchange unit 95 is inserted into the rear wall 912. The housing 90 further comprises the upper roof surface 91, the lower floor surface 92, the rear outer wall 900 with the transfer fitting 903 installed therein, and the first and second side surfaces 916, 918, which together with the front and rear walls 910, 912 delimit the containment system 9 from the exterior. The first side surface 916 has an inlet-side throughway 917, while the second side surface 916 has an outlet-side throughway 919. From the lower section of the front wall 910, located below the pane 911, there extends the projection 913 into the installation space 8 and a sloping, downwardly inclined intermediate floor 914 leading to the lowermost region of the rear wall 912. Furthermore, the horizontal divider 915 runs from the upper section of the front wall 910 to the rear wall 912, from which the upper cell wall 901 and the lower cell wall 902 each run horizontally to the rear outer wall 900.

The front region 94 and the rear space 99 are thus formed by the housing 90 and existing walls. The front region 94 is divided into the top compartment 98 above the divider 915, the bottom compartment 97 below the intermediate floor 914, and the process chamber 93 between the top compartment 98 and the bottom compartment 97. The transfer cell 96 is formed in the rear space 99 between the upper cell wall 901 and the lower cell wall 902. A transfer fitting 903, advantageously in the form of a rapid transfer port (RTP), in the rear outer wall 900 is used for the protected introduction of pre-sterilised components into the transfer cell 96. Further, glove ports 905 are provided in the outer wall 900, generally in pairs, to enable activities to be performed while maintaining the sterile atmosphere in the transfer cell 96.

The equipment of the containment system 9 comprises a dosing station 3, which is installed in the process chamber 93 and to which the functional module 2—here in the first version—is moved from the transfer cell 96 through a transfer port 260 into the operating position. The first version of the functional module 2 is the subject of the sequence of FIGS. 1A to 5, the detailed description of which explains the practical assembly procedure and the application of the device. A flange joint 20 built into a recess in the exchange unit 95 includes the transfer port 260. The functional module 2 is installed in a fixed but extendable manner at the flange joint 20. The element carrier 23 is an essential component of the functional module 2. To effect the movement to the dosing station 3, a robot 1 makes use of the manipulator 12, e.g. in the form of a gripper, guided by its pivoting arm 11. The robot 1 can advantageously be anchored to the rear wall 912 by its foot 10 below the exchange unit 95.

FIGS. 2A and 2B

This pair of figures illustrates the essential components of the functional module 2. They include:

a) the flange joint 20, which consists of a first gasket 21, a second gasket 21' of smaller diameter, a third gasket 27, the cover ring 22 and the moulded section 26 with its transfer port 260;

b) the front piece 24 with the handle 240 to be attached thereto;

c) the end piece 25 with the handle 250 to be attached thereto; and d) the element carrier 23, which is intended to be loaded with the functional elements 230.

FIGS. 3A and 3B

Solely for the purpose of clarity but not in accordance with the practical assembly procedure, this pair of figures illustrates the functional module 2, which, at this point, has been assembled without functional elements 230 being loaded and without media feed lines 231 being connected, and which has been moved from the transfer port 260 leading into the process chamber 93 to the dosing station 3. In the operating position shown, the front piece 24, which is fixed to the element carrier 23, is moved forward in the process chamber 93 and the end piece 25 fills the transfer port 260, at least partially sealing it. The cover ring 26 of the flange joint 20 integrated into the exchange unit 95 rests against the exchange unit 95 from the process chamber 93 side.

FIGS. 4A and 4B

Again in the operating position and for the purpose of clarity, but still not in conformity with the practical assembly procedure, the assembled functional module 2 can now be seen loaded with the functional elements 230 but still without the media feed lines 231 connected.

FIG. 5

Completing the assembly of the functional module 2 loaded with the functional elements 230, the media feed lines 231 are now also connected thereto, specifically directly to the opening into each of the functional elements 230. As in practice, the functional module 2 is in the actual operating position, i.e. drawn forward out of the transfer port 260 leading into the process chamber 93 to the dosing station 3 and with the end piece 25 positioned in the transfer port 260 and at least partially sealing it.

Assembly Procedure and Application of the First Version of the Functional Module Preparation and start of production proceed in the following steps:

1. The unloaded element carrier 23, i.e. no functional elements 230 have yet been inserted and no media feed lines 231 connected, is moved from the retracted initial position to an intermediate position in which the partially open transfer port 260 allows gas to pass between the process chamber 93 and the transfer cell 96.

2. While in the intermediate position, the process chamber 93 is decontaminated, a process that extends through the partially open transfer port 260 and into the transfer cell 96, thus flowing around the element carrier 23.

3. After decontamination of the process chamber 93, element carrier 23 and transfer cell 96, pre-sterilised functional elements 230 and media feed lines 231 are introduced into the transfer cell 96 while maintaining the clean room status. The protected introduction of the pre-sterilised components into the transfer cell 96 takes place by means of the transfer fitting 903.

4. The element carrier 23 returns to the retracted initial position, i.e. in the transfer cell 96, and the element carrier 23 is then loaded with the functional elements 230 and the media feed lines 231 are connected to the functional elements 230. This assembly work is performed by an operator using the glove ports 905 to maintain the sterile atmosphere in the transfer cell 96.

5. Once it has been processed and assembled, the fully loaded element carrier 23 can now be moved forward out of the transfer cell 96 into the process chamber 93 and up to the dosing station 3.

6. Vessels, in particular vessels to be filled with pharmacological liquid, preferably vials that are open at the top, are advantageously transported to the dosing station 3 with the manipulator 12 of the robot 1.

7. During the filling process, the liquid is supplied via the media feed lines 231 and the cannular functional elements 230, which dip into the vessels.

Assembly Procedure and Application of the Second Version of the Functional Module

FIG. 6

The division of the internal space, the existing walls and the equipment of the illustrated containment system 9 are in principle unchanged compared to FIGS. 1A+1B, and so reference is made thereto. However, a second version of the functional module 2 is now used, as illustrated in the sequence of FIGS. 6 to 8C. Furthermore, instead of the transfer device 903 installed in the rear outer wall 900, access to the transfer cell 96 is now possible through a simple wall opening 904, or the wall section at least along the transfer cell 96 is completely open.

The functional module 2 according to the second version—here in its retracted initial position—is, in contrast to the first version, not permanently fixedly installed at the flange joint 20 but can be docked thereto after being pushed in through the wall opening 904 at the flange joint 20, gaining access through its open transfer port 260. The functional module 2 has an externally sealed container 28, whose sterile interior 29 contains the fully loaded, pre-sterilised element carrier 23 when in the retracted initial position. The container 28 includes a passage 280, which is quasi-automatically closed in the initial position and through which the loaded element carrier 23 can be moved to reach the extended operating position.

FIGS. 7A to 7C

The essential components of the second version of the functional module 2 are described by reference to this sequence of figures. They include:

a) the gas-tight container 28 with the external assembly elements 282, the sterile interior 29 and the closable passage 280 bordered by a front window piece 281;

b) the element carrier 23 with the functional elements 230 inserted therein, the front piece 24 and the end piece 25, as well as the media feed lines 231 not shown here (see FIGS. 8A-8C);

c) the cover 285 for the rear closure of the container 28; and d) the pusher 286, e.g. designed as a spindle, and the actuator 287, here in the form of a rotary wheel.

FIG. 8A

In the retracted initial position, the element carrier 23 loaded with the functional elements 230 remains in the container 28 and is therefore not positioned at the dosing station 3. The front piece 24 closes the passage 280 in a gas-tight manner. The overlong media feed lines 231 connected to the functional elements 230 are positioned in the interior 29 of the container 28 and lead to the connection 232. As an example of the structure of the media feed lines 231, a media feed line 231 running from the connection 232 could advantageously be branched to connect to the individual functional elements 230. Preferably, however, for each functional element 230 a separate overlong media feed line 231 runs to a corresponding connection 232.

Before the start of production, i.e. with the functional module 2 still in the retracted initial position, it is necessary to decontaminate the process chamber 93 and, at the same time, the outer surface of the front piece 24, which currently hermetically seals the interior 29.

FIGS. 8B and 8C

When the actuator 287 is actuated, the pusher 286 is driven, thereby causing the front piece 24 gradually to move away from the passage 280 and, at the same time, causing the element carrier 23, together with its load, to move out of the container 28 into the process chamber 93 as far as the extended operating position at the dosing station 3. Inside the container 28, the end piece 25 comes to rest against the front region thereof. When the element carrier 23 moves out, the previously overlong media feed line 231 is stretched out. In the production process, the liquid to be processed at the dosing station 3 is supplied to the connection 232 from the outside, conveyed into the media feed line 231 and through it into the functional elements 230.

When using the first version (FIGS. 1A-5) and the second version (FIGS. 6-8C) of the functional module 2, vessels to be filled, e.g. a bundle of four vials, are advantageously transported to the dosing station 3 using the manipulator 12 of the robot 1. The vials are filled, with a pharmacological liquid for example, by means of the functional elements 230 which are held by the element carrier 23 and which are now likewise positioned in the dosing station 3. During the filling process, the cannular functional elements 230 dip into the vials, which are open at the top. When handling oxygen-sensitive liquids, filling is carried out with an overlay of a protective gas, e.g. nitrogen.

The invention claimed is:

1. A containment system for placement in an installation space, comprising:

a) a housing which encloses a process chamber;

b) a dosing station for the aseptic filling of vessels with a liquid, positioned in the process chamber;

c) a transfer port leading into the process chamber; and d) a functional module which can be moved up to the dosing station with an element carrier, functional elements installed on the element carrier, and media feed lines connected to the functional elements, wherein the functional module, with the element carrier, the functional elements mounted thereon and the media feed lines connected to the functional elements, is movable from an initial position, through a transfer port leading into the process chamber, to an operating position at the dosing station.

2. The containment system according to claim 1, wherein:

a) the functional module is used for the aseptic filling of a plurality of vessels, combined to form a bundle, with a pharmacological or toxic liquid; and b) when handling oxygen-sensitive liquids, a protective gas is overlaid.

3. The containment system according to claim 1, wherein:

a) the housing of the containment system has as a rear wall delimiting the process chamber; and b) the transfer port is formed by an opening provided in a moulded section of a flange joint installed in the rear wall.

4. The containment system according to claim 1, wherein:

a) the element carrier has a front piece fastened at the front and an end piece fastened at the rear; wherein:

b) in the initial position, the front piece comes to rest in the transfer port; and c) the end piece is designed to abut against the transfer port in the operating position and forms a throughway for the media feed lines running to the functional module.

5. The containment system according to claim 1, wherein:

a) in the initial position, the functional module installed at the transfer port projects into a transfer cell adjacent to the process chamber; and b) the transfer port forms an interface between the process chamber and the transfer cell.

6. The containment system according to claim 5, wherein: in an outer wall belonging to the housing of the containment system, which outer wall delimits the transfer cell from the installation space, there are provided:

a) a transfer fitting intended for the protected introduction of the pre-sterilised functional elements and media feed lines into the transfer cell; and b) glove ports designed to enable activities to be performed while maintaining the sterile atmosphere in the transfer cell, namely the loading of the element carrier with functional elements and media feed lines for connection thereto.

7. The containment system according to claim 6, wherein the transfer fitting is in the form of a rapid transfer port.

8. The containment system according to claim 1, wherein:

a) the functional module comprises:

aa) a gas-tight container with a sterilised interior; and ab) a sterilised assembly mounted in the container and comprising the element carrier, functional elements mounted thereon and media feed lines connected to the functional elements and leading to an external connection or external connections, as well as the front piece fastened to the front of the element carrier; wherein:

b) when retracted in the initial position, the assembly is positioned inside the container with the front piece sealing a passage on the container in a gas-tight manner; and c) the assembly, with the front piece leading, can be moved out of the container through the transfer port leading into the process chamber to reach its operating position at the dosing station.

9. The containment system according to claim 8, wherein there are provided thereon:

a) one or more connections on the outside of the container to which the media feed lines from the inside of the container are connected, the connection or connections being intended for connection to at least one supply line; and b) an actuator provided on the outside of the container for moving the assembly, comprising the element carrier with the front piece, functional elements mounted on the element carrier and media feed lines connected to the functional elements.

10. The containment system according to claim 8, wherein:

a) the functional module is installed at the transfer port in such a way that it projects into a transfer cell adjacent to the process chamber and can extend into the installation space, or the entire functional module extends freely into the installation space; and b) the external connection or external connections and an actuator for moving the assembly, comprising the element carrier with the front piece, functional elements mounted on the element carrier and media feed lines connected to the functional elements, are accessible from the installation space; wherein:

c) the transfer cell can be open to the installation space.

11. A method for operating the containment system according to claim 1, comprising:

a) outside the process chamber, preparing the element carrier with the loaded functional elements and the media feed lines connected thereto; and b) moving the mounted assembly, comprising the element carrier, functional elements mounted thereon and media feed lines connected to the functional elements, in a decontaminated or sterilised state from outside the process chamber through a sealed transfer port provided in a housing wall delimiting the process chamber to an extended operating position at the dosing station.

12. The method according to claim 11, wherein the preparation and assembly of the element carrier with functional elements and media feed lines are performed under aseptic conditions in a transfer cell which adjoins the process chamber and can be hermetically sealed off from the installation space.

13. The method according to claim 11, wherein:

a) with the element carrier partially extended into the process chamber, the front piece fixed to the front of the element carrier opens the transfer port between the process chamber and the transfer cell and enables the process chamber, transfer cell and element carrier to be decontaminated by injecting decontaminant; then b) the pre-sterilised functional elements and media feed lines are introduced into the transfer cell through the transfer fitting, maintaining aseptic conditions; and finally c) using glove ports, the element carrier is loaded with functional elements and the media feed lines are connected thereto, while maintaining the sterile atmosphere in the transfer cell.

14. The method according to claim 13, wherein the process chamber, transfer cell and element carrier are decontaminated by injecting decontaminant simultaneously from the process chamber side and the transfer cell side.

15. The method according to claim 11, wherein:

a) in its initial position, the mounted assembly, comprising the element carrier, functional elements mounted thereon and media feed lines connected to the functional elements, is located in the transfer cell and a front piece located at the front of the element carrier is positioned in the transfer port while b) to reach the operating position, the mounted assembly is moved out of the transfer cell to the dosing station.

16. The method according to claim 11, wherein:

a) to reach the operating position, the mounted assembly, comprising the element carrier with the front piece, functional elements mounted on the element carrier and media feed lines connected to the functional elements, is moved out of the transfer cell, guided or supported in a slide-like manner, until the end piece located at the rear of the element carrier abuts against the transfer port; wherein b) the assembly is moved into the operating position by pushing it from the transfer cell side or by pulling it from the process chamber side.

17. A method for moving the operating the containment system according to claim 1, comprising:

a) preparing the functional module, including:

aa) a gas-tight container with a sterilised interior; and ab) the sterilised assembly mounted in the container and comprising a element carrier with a front piece, functional elements mounted on the element carrier and media feed lines connected to the functional elements and leading to a common external connection or individual connections, wherein:

ac) when retracted in the initial position, the assembly is positioned inside the container with the front piece sealing a passage on the container in a gas-tight manner; and ad) to reach the operating position, the assembly with the front piece leading can be moved out of the container to the dosing station, guided in a slide-like manner;

b) installing the functional module in the initial position sealed against the transfer port so that the outer surface of the front piece faces into the process chamber;

c) decontaminating the process chamber concurrently with the outer surface of the front piece;

d) advancing the assembly to the dosing station in order to reach the operating position; and finally e) connecting supply lines to the external connection or external connections, wherein method step e) can alternatively take place between method steps c) and d) or between method steps b) and c).

18. The method according to claim 17, wherein:

a) the functional module is installed at the transfer port in such a way that the functional module projects into a transfer cell adjacent to the process chamber and can extend into the installation space, or the entire functional module extends freely into the installation space; and b) the external connection or the external connections and an actuator for moving the assembly, comprising the front piece with the element carrier, functional elements mounted thereon and media feed lines connected to the functional elements, are accessible from the installation space and/or from the transfer cell.

* * * * *